US006808477B2

(12) United States Patent
Tudor

(10) Patent No.: US 6,808,477 B2
(45) Date of Patent: Oct. 26, 2004

(54) MARTIAL ARTS DUMMY SUPPORTING ARRANGEMENT

(76) Inventor: Byron D. Tudor, 620 Deanna Dr., Batavia, OH (US) 45103

( * ) Notice: Subject to any disclaimer, the term of this patent is extended or adjusted under 35 U.S.C. 154(b) by 151 days.

(21) Appl. No.: 10/189,061

(22) Filed: Jul. 3, 2002

(65) Prior Publication Data

US 2004/0005963 A1 Jan. 8, 2004

(51) Int. Cl.[7] ..... A63B 69/00
(52) U.S. Cl. ..... 482/83; 482/87; 482/90
(58) Field of Search ..... 482/83–90; 473/441–445, 473/438, 422

(56) References Cited

U.S. PATENT DOCUMENTS 694,335 A * 2/1902 Thenan et al.
3,427,021 A * 2/1969 Donato
3,888,481 A * 6/1975 Adams, Jr. et al.
D237,869 S * 12/1975 Siroki
5,256,069 A * 10/1993 Snowden, Jr. et al.

* cited by examiner

*Primary Examiner*—Jerome W. Donnelly
(74) *Attorney, Agent, or Firm*—Alfred J. Mangels

(57) ABSTRACT

An arrangement for supporting from a wall or column a martial arts dummy. The dummy has a vertically-extending, cylindrical body member that carries outwardly-extending arms and a leg to generally simulate a person for martial arts training and practice. A mounting bar that can be secured to a wall or column supports a pair of parallel, horizontal rods that carry a horizontal slat that passes laterally through the vertically-extending body of the dummy to allow side-to-side movement of the dummy along the slat. The outer ends of the rods include a stop member. Respective first and second springs are positioned between the slat and the mounting bar and between the slat and the stop members to allow forward and backward movement of the dummy in response to blows applied by the user.

13 Claims, 3 Drawing Sheets

MARTIAL ARTS DUMMY SUPPORTING ARRANGEMENT

BACKGROUND OF THE INVENTION

1. Field of the Invention

The present invention relates to a supporting arrangement for a martial arts dummy that is utilized for training in the performance of martial arts movements and also for enabling one to practice martial arts movements. More particularly, the present invention relates to a martial arts dummy supporting arrangement for supporting a dummy from a vertically-extending member, such as a wall or a column, and in which the dummy is resiliently supported to enable the dummy to be moved by a user both away from and toward the user and to return to a neutral position when the user's movement force is released.

2. Description of the Related Art

Interest in martial arts studies has been increasing over the years. In classes in which martial arts movements are taught practitioners often practice by performing the movements against each other. But when away from the class, and in the absence of another practitioner, resort is had to various devices to simulate an opponent and thereby enable practitioners to practice by themselves the movements they have learned.

One particular form of device that is utilized in practicing various arts of Kung Fu is a wooden dummy referred to either as Mook Jung, Wing Chun dummy, or Wooden Man. Such a dummy is in the form of a cylindrical, vertically-extending body that includes several outwardly-extending arms located near its upper end, and a forwardly- and downwardly-extending leg located near its lower end. Such dummies are often mounted on stands that are free standing. Some stands include a hollow base into which sand or water can be placed for ballast, to minimize tipping over of the dummy and stand when subjected to strong impacts by a practitioner. Other dummies are supported from a wall mounting structure and are slidably carried on a pair of horizontally-arranged, bars or slats that allow minimal vertical and forward and back movements of the dummy, while allowing the dummy to slide sideways along the slats in response to impacts made by the practitioner in practicing various movements.

The known support arrangements for such dummies do not allow much forward and back movements of the dummy to react to rearward or forward impacts applied to the dummy by the practitioner. Accordingly, the relatively unyielding dummy cannot suitably simulate the reactions of a human when such forward or backward movements are applied to it. It is therefore desirable to provide a mounting arrangement for martial arts dummies that enables the dummy to yield in response to a wide variety of impacts applied to it by a practitioner practicing martial arts movements.

SUMMARY OF THE INVENTION

Briefly stated, in accordance with one aspect of the present invention, a support arrangement is provided for supporting a martial arts dummy from a rigid, substantially vertically-extending surface. The dummy includes a tubular body member with a pair of axially-spaced, transversely-extending slots for receiving respective slats forming part of the support arrangement, which includes an elongated mounting bar for attachment to the substantially-vertically-extending surface. A pair of support rods are rigidly carried by the mounting bar and extend outwardly therefrom and terminate in a stop member. A slat is carried on the support rods, the slat having a pair of longitudinally-spaced openings for receiving a respective support rod and for enabling axial sliding movement of the slat along the support rods and toward and away from the mounting bar. A first biasing member is carried by each of the support rods and is positioned between the mounting bar and the slat to bear against and to bias the slat in a direction away from the mounting bar. A second biasing member is carried by each of the support rods and is positioned between the slat and the stop member carried by the support rod for bearing against and for biasing the slat in a direction toward the mounting bar and against a biasing force exerted by the first biasing member. The first and second biasing members resiliently support the slat in an intermediate position between the mounting bar and the stop members carried by the support bars.

DESCRIPTION OF THE PREFERRED EMBODIMENTS

Figure 1:
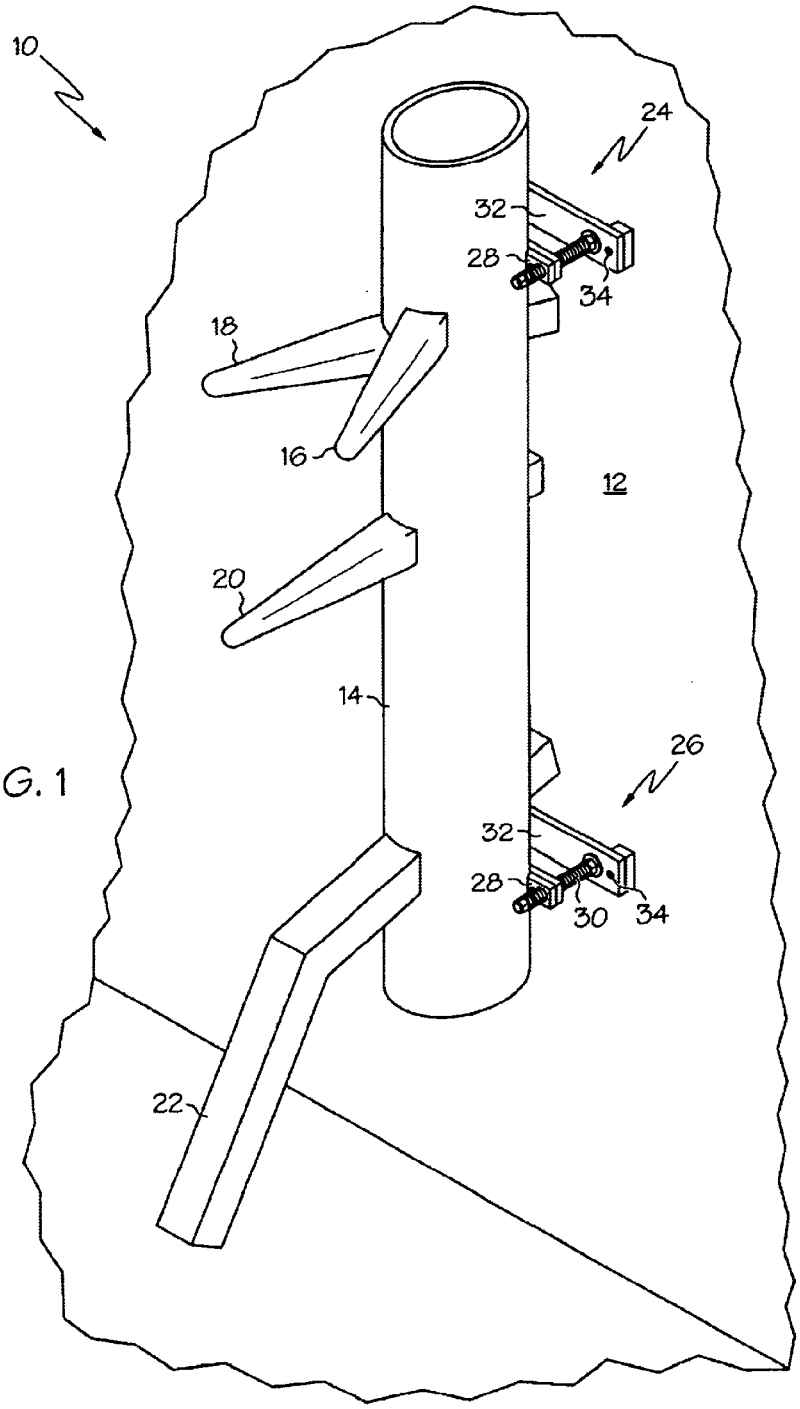
FIG. 1 is a perspective view of a martial arts dummy carried on an embodiment of a wall-mounted support arrangement.
Figure 2:
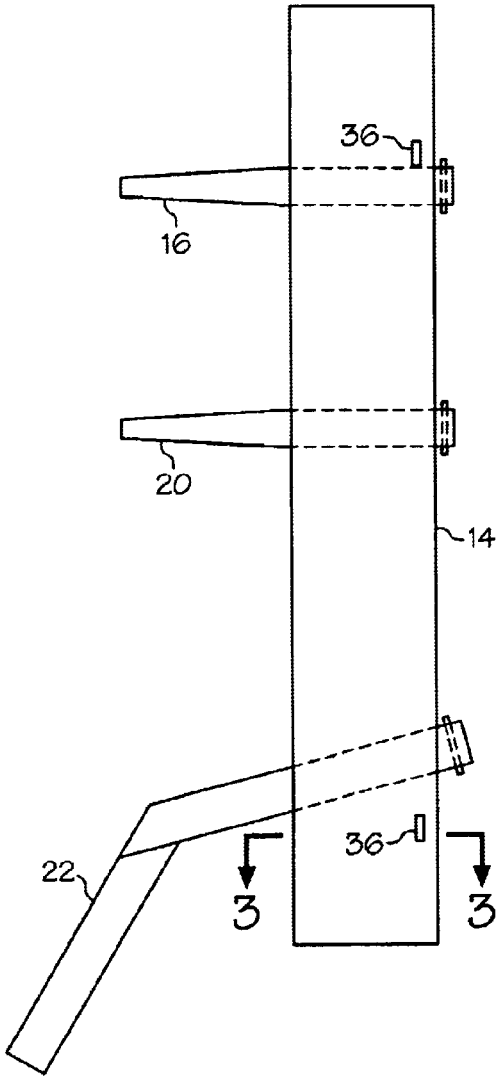
FIG. 2 is a side elevational view of the dummy showing a pair of axially-spaced, transversely-extending slots in the dummy body member.

Referring to the drawings, and particularly to FIG. 1 thereof, there is shown a martial arts dummy 10 that is supported from and spaced outwardly from a wall 12. Dummy 10 is in the form of a Mook Jung dummy and includes a cylindrical body 14 that can be of tubular form. Dummy 10 includes three outwardly-extending wooden arms 16, 18, and 20. As shown, arm 16 extends in a forward direction, substantially perpendicular to the surface of wall 12, whereas arms 18 and 20 extend in a generally lateral direction. Dummy 10 also includes a forwardly- and downwardly-extending wooden leg 22. Each of arms 16, 18, and 20, as well as leg 22, extends through respective, suitably placed slots provided in body 14, as shown in FIG. 2. However, the number of arms and legs, the positions of the arms and legs, and the orientation of the respective arms and legs can be changed, and it should be understood that the arm leg arrangement shown is merely illustrative of one possible dummy configuration.

Dummy 10 is carried on an upper mount 24 and a lower mount 26 that are vertically spaced along the axis of body 14. Each mount includes a generally horizontally-extending slat 28. Each of slats 28 is carried on a pair of substantially parallel support rods 30 (only one of each of which is visible in FIG. 1 for each slat) that are secured to and that extend outwardly from a respective mounting bar 32. Each of mounting bars 32 is rigidly secured to wall 12 by screws 34, or by another suitable connection means.

Figure 3:
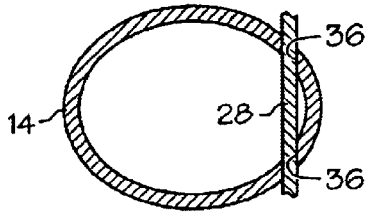
FIG. 3 is a cross-sectional view taken along the line 3—3 of FIG. 2.

As shown in FIG. 3, slats 28 extend into and through respective pairs of aligned slots 36 that are provided in body 14, which can be a tubular structure, as shown, or it can be solid, if desired. Slots 36 each extend in a direction substantially perpendicular to the longitudinal axis of body 14 and are radially offset from that axis.

Figure 4:
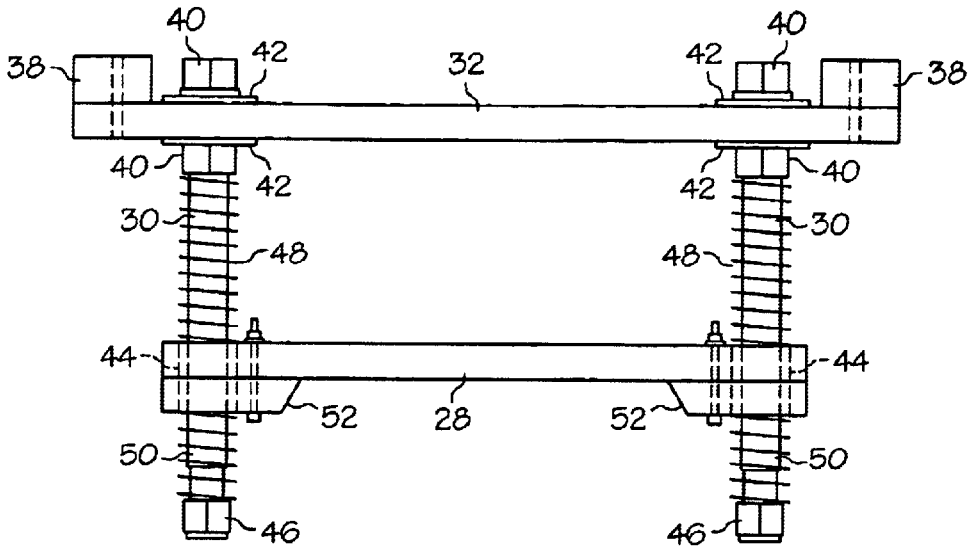
FIG. 4 is a top view of the dummy mounting arrangement shown in FIG. 1.
Figure 5:
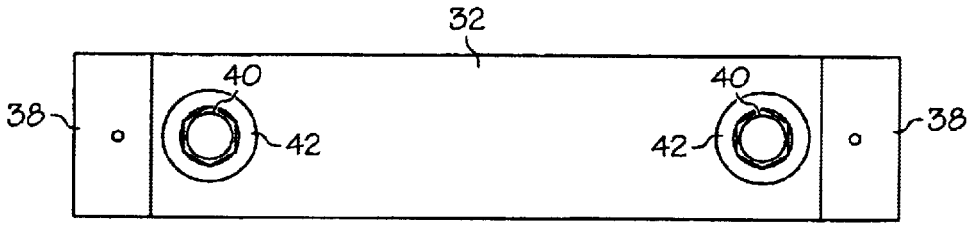
FIG. 5 is a rear view of the dummy mounting arrangement shown in FIG. 1.
Figure 6:
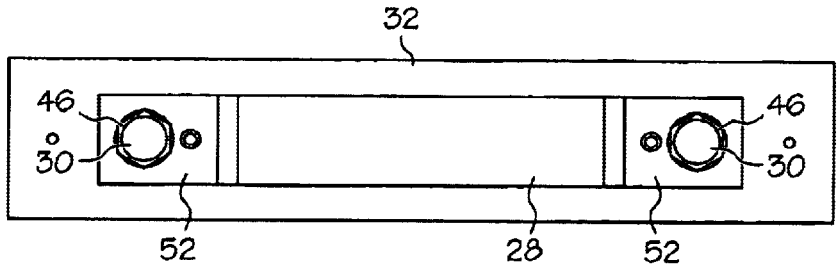
FIG. 6 is a front view of the dummy mounting arrangement shown in FIG. 1.

The structural elements of upper and lower mounts 24, 26 for supporting dummy 10 from wall 12 are shown in greater detail in FIGS. 4, 5, and 6. Mounting bar 32 can have a length that is slightly larger than the usual 16 inch center-to-center spacing of wall studs, to enable the bar to be attached to the wall by screws 34 (see FIG. 1) that pass into the studs (not shown). Spacer blocks 38 can be provided on the wall-facing side of mounting bar 32 at each end to space the rear face of the bar from the wall a distance sufficient to accommodate connecting nuts 40 carried at the inner, wall ends of support rods 30.

Support rods 30 are preferably made from metal for strength, although other high-strength materials can also be employed. As shown, support rods 30 are steel rods that pass through mounting bar 32 and that have threaded end sections at each end. Rods 30 can be connected to mounting bar 32 by a pair connecting nuts 40 and washers 42 that secure rods 30 in position. Slat 28 includes a pair of longitudinally-spaced throughbores 44 that are spaced from each other a distance sufficient to allow slats 28 to be slidably carried along each of support rods 30. Although throughbores 44 can be substantially the same diameter as that of support rods 30, to allow only axial movement of slats 28 along support rods 30, if they are made somewhat larger, slats 28 can tilt relative to the axes of support rods 30, in addition to moving axially therealong. The outermost end of each of support rods 30 includes a suitable stop member 46, such as a stop nut that can be threadedly carried on the outer end of the rod.

Slat 28 is spaced inwardly from each of the outer ends of support rods 30, between mounting bar 32 and stop members 46. A first biasing member 48, which can be a compression coil spring as shown, is positioned between mounting bar 32 and slat 28, to space the slat from the mounting bar and to resiliently support slat 28 relative to mounting bar 32. Similarly, a second biasing member 50, which can also be a compression coil spring, is positioned between slat 28 and stop member 46, to space the slat from the stop member. Although any suitable form of biasing members can be employed, the compression coil springs shown in the drawings are readily available and can be provided in a variety of spring rates. In that regard, and depending upon whether the practitioner using the dummy is a child or an adult, the biasing members can be selected to provide a spring rate range of from about 12 lb/in to about 40 lb/in. For an adult practitioner, a spring rate of 35 lb/in has been found to be suitable to provide sufficient resistance to pushing or pulling blows by the adult practitioner.

When provided as compression coil springs first and second biasing members 48, 50 can be of different lengths, if desired. As shown in FIG. 4, the springs constituting first biasing member 48 are about twice as long as the springs constituting second biasing members 50, which allow larger dummy movements in a rearward direction, because stronger pushing blows are provided by kicking movements, which generally result in larger forces and resulting larger spring deflections than pulling movements in a forward direction. Additionally, a desired preload can be imposed on the springs by suitably tightening or loosening stop members 46.

As will be appreciated by those skilled in the art, the dummy supported as shown and described herein can react in various directions to blows applied by a practitioner. It can move rearwardly in response to pushing movements, and it can move forwardly in response to pulling movements. It therefore provides resilient resistance to pulling and pushing movements. Similarly, side-to-side movements of the dummy can take place along slats 28. In that regard, slats 28 carry respective end stop members 52, the spacing between which limit the extent of sidewise movement of the dummy.

Although particular embodiments of the present invention have been illustrated and described, it will be apparent to those skilled in the art that changes and modifications can be made without departing from the spirit of the present invention. Accordingly, it is intended to encompass within the appended claims all such changes and modifications that fall with the scope of the present invention.

What is claimed is:

1. A support arrangement for supporting a movable exercise device from a rigid, substantially vertically-extending surface, said support arrangement comprising:

a. an elongated mounting bar for attachment to the substantially-vertically extending surface;

b. a pair of support rods rigidly carded by the mounting bar and extending outwardly therefrom and terminating in a stop member;

c. a slat carried on the support rods, the slat having a pair of longitudinally-spaced openings for receiving a respective support rod and for enabling axial sliding movement of the slat along the support rods and toward and away from the mounting bar;

d. a first biasing member carried by each of the support rods and positioned between the mounting bar and the slat to bear against and bias the slat in a direction away from the mounting bar;

e. a second biasing member carried by each of the support rods and positioned between the slat and the stop member carried by the support rod for bearing against and biasing the slat in a direction toward the mounting bar and against a biasing force exerted by the first biasing member;

f. whereby the first and second biasing members resiliently support the slat in an intermediate position between the mounting bar and the stop members carried by the support bars; and g. a movable exercise device carried by the slat.

2. A support arrangement as claimed in claim 1, wherein the mounting bar includes mounting holes that are spaced a distance corresponding with a wall stud spacing to allow securing of the mounting bar relative to a pair of spaced wall studs.

3. A support arrangement as claimed in claim 1, wherein the stop members are stop nuts threadedly carried by the support bars.

4. A support arrangement as claimed in claim 1, wherein the biasing members are springs.

5. A support arrangement as claimed in claim 4, wherein the springs are coil springs.

6. A support arrangement as claimed in claim 5, wherein the springs have a spring rate of from about 12 lb/in to about 40 lb/in.

7. A support arrangement as claimed in claim 6, wherein the spring rates of the springs are the same.

8. A support arrangement as claimed in claim 7, wherein the spring rates of the springs is about 35 lb/in.

9. A support arrangement as claimed in claim 5, wherein springs located between the mounting bar and the slat have an axial length that is about twice that of springs located between the slats and the stop members.

10. A support arrangement as claimed in claim 4, wherein the stop members are stop nuts threadedly carried by the support rods and are movable along the support rods to allow a predetermined pre-load to be applied to the springs.

11. A support arrangement as claimed in claim 1, wherein the movable exercise device is a martial arts dummy.

12. A support arrangement as claimed in claim 11, wherein the martial arts dummy includes a tubular body member with at least one transversely-extending slot for receiving a slat.

13. A support arrangement as claimed in claim 12, including a pair of spaced, substantially parallel slats carried on respective support rods and including respective first and second biasing members, and wherein the martial arts dummy includes a pair of spaced, substantially parallel slots for receiving respective slats.

* * * * *